US008333854B2

(12) United States Patent
Coffey et al.

(10) Patent No.: US 8,333,854 B2
(45) Date of Patent: Dec. 18, 2012

(54) THERMITE COMPOSITIONS, ARTICLES AND LOW TEMPERATURE IMPACT MILLING PROCESSES FOR FORMING THE SAME

(75) Inventors: Kevin Coffey, Oviedo, FL (US); Edward Dein, Saint Cloud, FL (US); Dickson Hugus, Chuluota, FL (US); Edward Sheridan, Orlando, FL (US)

(73) Assignees: University of Central Florida Research Foundation, Inc., Orlando, FL (US); Lockheed Martin Corporation, Bethesda, MD (US)

( * ) Notice: Subject to any disclaimer, the term of this patent is extended or adjusted under 35 U.S.C. 154(b) by 174 days.

(21) Appl. No.: 12/596,375

(22) PCT Filed: Apr. 18, 2008

(86) PCT No.: PCT/US2008/060892

§ 371 (c)(1),
(2), (4) Date: Apr. 14, 2010

(87) PCT Pub. No.: WO2008/131273

PCT Pub. Date: Oct. 30, 2008

(65) Prior Publication Data

US 2010/0193093 A1 Aug. 5, 2010

Related U.S. Application Data

(60) Provisional application No. 60/912,468, filed on Apr. 18, 2007.

(51) Int. Cl.

| | |
|---|---|
| ***C06B 45/00*** | (2006.01) |
| ***C06B 45/12*** | (2006.01) |
| ***C06B 45/14*** | (2006.01) |
| ***D03D 23/00*** | (2006.01) |
| ***D03D 43/00*** | (2006.01) |

(52) U.S. Cl. ..... 149/109.6; 149/2; 149/14; 149/15; 149/109.2

(58) Field of Classification Search ..... 149/15, 149/2, 14, 109.2, 109.4

See application file for complete search history.

(56) References Cited

U.S. PATENT DOCUMENTS

| | | | | |
|---|---|---|---|---|
| 4,383,484 | A * | 5/1983 | Morrey | 102/275.3 |
| 4,923,535 | A | 5/1990 | Waters et al. | |
| 6,308,607 | B1 * | 10/2001 | Woodall et al. | 89/1.13 |
| 2005/0067074 | A1 * | 3/2005 | Hinshaw et al. | 149/45 |
| 2006/0053970 | A1 * | 3/2006 | Dreizin et al. | 75/354 |

* cited by examiner

*Primary Examiner* — James McDonough
(74) *Attorney, Agent, or Firm* — Jetter & Associates, P.A.

(57) ABSTRACT

A process for the preparation of composite thermite particles, and thermite particles and consolidated objects formed from a plurality of pressed composite particles. The process includes providing one or more metal oxides and one or more complementary metals capable of reducing the metal oxide, and milling the metal oxide and the metal at a temperature below −50° C., such as cryomilling, to form a convoluted lamellar structure. The average layer thickness is generally between 10 nm and 1 μm. The molar proportions of the metal oxide and metal are generally within 30% of being stoichiometric for a thermite reaction.

15 Claims, 1 Drawing Sheet

THERMITE COMPOSITIONS, ARTICLES AND LOW TEMPERATURE IMPACT MILLING PROCESSES FOR FORMING THE SAME

CROSS-REFERENCE TO RELATED APPLICATIONS

This application is a U.S. National stage application of PCT Application number PCT/US2008/60892 filed Apr. 18, 2008 which claims priority to U.S. Provisional Application No. 60/912,468 entitled "NANOSTRUCTURED ENERGETIC MATERIALS PREPARED BY CRYOGENIC IMPACT MILLING" filed on Apr. 18, 2007, which are both incorporated by reference in their entirety into this application.

FIELD

Disclosed embodiments pertain to thermite particles, and objects and articles therefrom, and processes to form the same.

BACKGROUND

Thermite is a type of pyrotechnic composition of a metal and a metal oxide which produces a highly exothermic reaction, known as a thermite reaction. Thermite reactions have been of interest since the introduction of the Goldschmidt reaction, patented in 1895, between aluminum and iron oxide for the welding of railroad tracks. Other thermite reactions, such as between aluminum and copper oxide illustrated in the equation below, are of interest as propellants and explosives in aerospace, military, and civil applications. Explosives from inorganic reagents, though similar in the energy released per unit weight from conventional organic explosives, have the potential to release 3 to 5 times the energy per unit volume more than organic explosives.

$$2Al+3CuO \rightarrow Al_2O_3+3Cu \qquad \text{Equation 1}$$

The reagents for thermite reactions are both solid materials which do not readily permit their mixing in a manner where a self propagating reaction is readily and consistently achieved. The use of such reagents as reactive powders was developed in the early 1960s, spawning what is known as Self-Propagating, High-Temperature Synthesis (SHS) where a wave of chemical reaction propagates from an ignition site over the bulk of the reactive mixture by layer-by-layer heat transfer. SHS reactions often require substantial preheating to self-propagate. Controlling the rate and manner in which their energy is released in these reactions is often difficult. Where very fine powders, whose mixtures are also referred to as metastable intermolecular composites, are used, thermite reactions are often defined as superthermite reactions as the nature of the small particles overcome some of the difficulties in achieving a readily initiated self-propagating reaction. Performance properties of such energetic materials are strongly dependent on particle size distribution, surface area of the constituents, and void volume within the mixtures. The general approach to improving such reactions between solid materials has been to increase the amount and nature of the interface between the solid reactants.

Drawing techniques have been used to achieve a large interface area between the two solid reactants. In these applications a relatively large metal rod is periodically drilled and filled with the metal oxide and drawn until the final material is in the form of a thin wire. This technique is known to have limitations with respect to the homogeneity of the mixture.

One approach to increasing the interface between solid reactants has been to been to use thin films of the materials in a laminate type. Success with this approach has required that films are prepared that have individual layer thickness in the range of microns to as small as angstroms. Such thicknesses have required methods such as vapor deposition. Unfortunately, vapor deposition techniques are generally impractical for the formation of large quantities of such materials due to the nature and expense of the process.

To accommodate techniques common for the fabrication of propellants and explosives, the use of powders has generally been chosen. In these applications homogeneous mixing is essential at the desired stoichiometry, which is not always achieved, as the mixing of two powders can be very inconsistent. With larger sized particles, such as 1 or more 1 μm in diameter, the amount of effective interface can be lower than desired and the initiation and propagation of reactions can suffer. Further complicating this approach is that commercially available nanoparticles, of significantly less than 1 μm in diameter, generally do not provide the quality of interface that is necessary as virtually all of these metal particles appropriate for thermite reactions form an oxide layer on their surface upon exposure to air. In the case of aluminum, the most commonly used metal for such systems, the oxide layers can be very thick relative to the diameter of the particles, and in the worst case can be almost exclusively aluminum oxide. This problem has led to the investigation of co-milling the metal with the metal oxide to give a homogeneous nanoparticulate mixture.

The milling of such mixtures has the advantage that it can begin with larger particles where the metals have a relatively small, generally insignificant, amount of oxide layer. However, co-milling processes tend to initiate the thermite reaction and do not permit the isolation in a manner that yields consistently viable thermite mixtures.

SUMMARY

This Summary is provided to comply with 37 C.F.R. §1.73, presenting a summary of the invention briefly indicating the nature and substance of the invention. It is submitted with the understanding that it will not be used to interpret or limit the scope or meaning of the claims.

A process for the preparation of composite thermite particles includes providing one or more metal oxides and one or more complementary metals capable of reducing the metal in the metal oxide, and milling the metal oxide and the metal at a temperature below −50° C. to form a convoluted lamellar structure. The convoluted lamellar structure comprises alternating layers of metal oxide and metal. As defined herein, a "convoluted lamellar structure" refers to an alternating meandering stack of layers of the metal and metal oxide starting materials, wherein the layer thickness will generally be between 10 nm and 1 μm, and be varying in thickness in the resulting milled thermite composition to a significant extent. The resulting milled thermite compositions can be used in propellant and explosive devices as with conventional thermite, but permit significantly better control of the ignition and propagation phases of the thermite reaction.

The milling can be performed at a cryogenic temperature, referred to herein as cryomilling. As used herein, low milling temperatures refer to temperatures below −50° C., while cryogenic milling temperatures generally refer to temperatures below −150° C. (=−238° F. or 123 K).

The particles generally have a dimension between 1 μm and 100 μm. In one embodiment, the layers of metal oxide and metal have an average thickness of between 10 nm and 0.1 μm, and the particles have a dimension between 0.3 μm and 10 μm.

The process can further comprise the step of pressing a plurality of particles to form a consolidated object. The pressing can be performed at room temperature or at lower temperatures, e.g., below −50° C. A fluidic binder can be added before pressing, such as a thermosetting or thermoplastic polymer. Polyethylene is an example of a suitable binder. In another embodiment the binder can comprise an organic explosive, such as trinitrotoluene (TNT). The molar proportions of the metal oxide and metal are generally within 30% of being stoichiometric for a thermite reaction.

A thermite composition comprises at least one particle having a convoluted lamellar structure. The molar proportions of the metal oxide and metal are within 30% of being stoichiometric for a thermite reaction. The composition can comprise a consolidated object comprising a plurality of particles pressed together, and can include a binder, such as an organic binder. In one embodiment the metal comprises Al and the metal oxide comprises CuO.

FIGURES

DETAILED DESCRIPTION OF THE INVENTION

Figure 1:
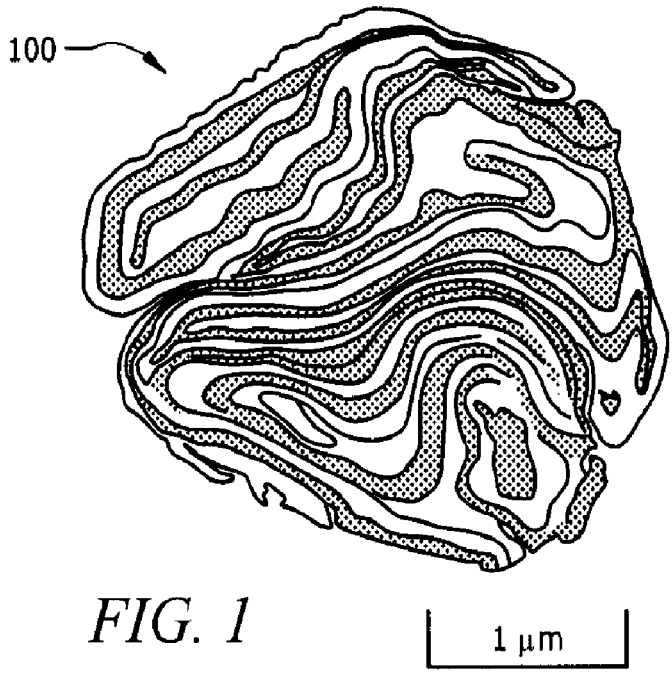
FIG. 1 is a depiction derived from a scanning electron micrograph (SEM) image of a composite particle according to an embodiment of the invention displaying an exemplary convoluted lamellar structure, obtained by mechanical milling according to an embodiment of the invention.

Disclosed embodiments are described with reference to the attached figures, wherein like reference numerals are used throughout the figures to designate similar or equivalent elements. The figures are not drawn to scale and they are provided merely to illustrate the disclosed embodiments. Several disclosed aspects are described below with reference to example applications for illustration. It should be understood that numerous specific details, relationships, and methods are set forth to provide a full understanding of the disclosed embodiments. One having ordinary skill in the relevant art, however, will readily recognize that the disclosed embodiments can be practiced without one or more of the specific details or with other methods. In other instances, well-known structures or operations are not shown in detail to avoid obscuring the invention. The disclosed embodiments are not limited by the illustrated ordering of acts or events, as some acts may occur in different orders and/or concurrently with other acts or events. Furthermore, not all illustrated acts or events are required to implement a methodology in accordance with the disclosed embodiments.

Disclosed embodiments are directed to processes for preparing thermite compositions of a metal and a complementary metal oxide, and resulting thermite compositions and articles therefrom. The process involves the low temperature milling at <−50° C., including cryomilling in one embodiment, of a metal with a metal oxide to form particles having a convoluted lamellar structure comprising alternating layers of the metal oxide and metal. Unlike known milling processes for forming thermite compositions, the Inventors have discovered that low temperature milling such as cryogenic milling coupled with limiting milling parameters (e.g., time) to avoid atomic level or near atomic level mixing of the starting materials has enabled the shear of the respective components without any significant initiation of the thermite reaction. As a result, the stored total energy of the resulting particles are generally increased as compared to conventionally milled thermite compositions. The speed of energy release may also be increased.

Cryomilling takes place within a ball mill such as an attritor with metallic or ceramic balls. During milling, the mill temperature is lowered, for example, by using liquid nitrogen, liquid argon, liquid helium, liquid neon, liquid krypton or liquid xenon. In an attritor, energy is supplied in the form of motion to the balls within the attritor, which impinge portions of the powder within the attritor, causing repeated fracturing and solid state welding of the metal and metal oxide.

The layers of metal oxide and metal generally have an average thickness of between 10 nm and 1 μm. The total size of the particle is <100 μm, and is generally <10 micron. In some applications, a loose powder comprising a plurality of particles may be desired.

Consolidated objects comprising a plurality of pressed particles may also be formed. To form consolidated objects, a plurality of particles disclosed herein may be pressed together to form a consolidated object. Such consolidated objects are generally macroscopic dimensioned, with dimensions of a few millimeters up to tens of centimeters.

Pressing can be performed at room temperature or at lower a temperature, such as below −50° C., for example using a process comprising cold isostatic pressing (CIP). A fluidic binder may be added before or after pressing to reduce resulting porosity. In one embodiment, the binder comprises an organic explosive, such as trinitrotoluene (TNT). In another embodiment, the binder comprises a polymer.

Any appropriate metal can generally be coupled with an appropriate complementary metal oxide at stoichiometric proportions, or near stoichiometric proportions (e.g., within 30%) to achieve a high energy yield from the exothermic reaction. The following list provides a number of exemplary metal oxides in the order of their heat of formation from the metal and oxygen per mole of oxygen. The list of exemplary metal oxides includes, but is not limited to, AgO, $PbO_2$, CuO, $Ni_2O_3$, $CuO_2$, $Bi_2O_3$, $Sb_2O_3$, PbO, COO, $MoO_3$, CdO, $MnO_2$, $Fe_2O_3$, $Fe_3O_4$, $WO_3$, $SnO_4$, $SnO_2$, $WO_2$, $V_2O_5$, $K_2O$, $Cr_2O_3$, $Ta_2O_5$, $Na_2O$, $B_2O_3$, $SiO_2$, $TiO_2$, $UO_2$, $CeO_2$, BaO, $ZrO_2$, $Al_2O_3$, SrO, $Li_2O$, $La_2O_3$, MgO, BeO, $ThO_2$, and CaO. For any selected metal oxide an appropriate complementary metal is that of any metal in the metal oxide appearing later in the list. An appropriate metal oxide—complementary metal pair can be chosen that also considers factors such as: chemical hazards, toxicity, radioactivity, density, and cost. The metal oxide—metal pair where the oxide may be chosen from those listed near the beginning of the list with the metal from the metal oxide listed near the end of the list to generally provide the greatest energy density. This complementary pair may be helpful since a self sustaining reaction at ordinary temperatures generally requires that an exotherm of approximately 400 cal/g is generated.

The metal oxide metal mixtures need not be a single metal oxide with a single metal but can also include two or more metals, added either separately or as an alloy, and can include two or more metal oxides or a mixed metal oxide. When multiple metal oxides or metals are used, all metal oxides used can reside earlier in the list than the metal oxides that will be formed from the metal used in the mixture. For the various reasons given, metal oxides can be CuO, $CuO_2$, $Fe_2O_3$, CoO, NiO, $MoO_3$, $Fe_3O_4$, $WO_3$, $SnO_4$, $Cr_2O_3$ and $MnO_2$. Metals can include Al, Zr, and Mg. In general the proportions of the metals and metal oxides used will be included based on stoichiometry but a metal or metal oxide rich mixture can be used for certain desired applications of the resulting particulate mixture of the invention.

As described above, cryomilling can be used to mix the metal oxide—metal. The cryogenic temperatures can vary where the mill and mixture are cooled via a carbon dioxide based system or a liquid nitrogen based system. Other cooling systems, including chlorofluorocarbon and hydrochlorofluorocarbon-based cooling systems, can be used to achieve cryogenic temperatures.

Ball milling generally provides the ability to achieve extremely small particles as compared to other milling techniques which employ impellers which are generally more limited regarding the minimum dimensions that can be achieved. The balls used can be either metallic or ceramic, however, the balls should generally have a higher hardness than the components of the mixture or are otherwise resistant to wear in the process such that significant masses of material other than the desired metal and complementary metal oxide are excluded from the thermite mixture. It is also possible to construct the balls out of a metal or metal oxide included in the mixture to be milled.

Appropriate apparatus for cryogenic milling and ball milling are available. In general, the metal oxide—metal mixture is pre-chilled to approximately the milling temperature before introduction to the mill. It is also intended that the temperature within the milling apparatus is constantly monitored such that milling can be stopped immediately, manually or automatically using a controller coupled to the temperature gauge, if the temperature exceeds the desired temperature to avoid the possibility of initiation of the thermite reaction during milling.

In the milling process, the metal and metal oxide can be introduced as powders or other small particles. Although some oxide coating can exist on the metal, if desired metal particles that have been prepared and stored under non-oxidizing or otherwise non-reactive atmospheres can be used. The atmosphere within the mill and the atmosphere over the product removed from the mill can be non-oxidizing, such as provided by an inert gas. Appropriate non-oxidizing atmospheres include nitrogen, argon or other noble gases. This permits the isolation of a metastable intermolecular composite which can subsequently be incorporated into a device where the thermite reaction of the mixture can be initiated to release the energy.

The milling process results in a powder comprising a plurality of composite particles. The composite particles comprise a mixture of metal and metal oxide regions. These regions have an average size dependent upon the force used and duration of the milling. During high-energy milling as disclosed herein, the powder particles are repeatedly flattened, cold welded, fractured and rewelded. Whenever two steel or other metal milling balls collide, some amount of powder is trapped in between them. In one embodiment, around 1,000 particles with an aggregate weight of about 0.2 mg are trapped during each collision. The force of the impact plastically deforms the powder particles leading to work hardening and fracture. The new surfaces created enable the particles to weld together and this leads to an increase in particle size. A broad range of particle sizes develops, with some as large as three times bigger than the starting particles. The composite particles at this stage have a characteristic layered structure comprising various combinations of the starting constituents in an internal convoluted lamellar structure. It has been discovered by the Inventors that if this process is carried out too long, the process produces a compositionally homogenous material (e.g., mechanical alloy with atomic scale or near atomic scale particles), rather than the lamellar structure desired for the energetic materials disclosed herein. It has been found that atomic scale or near atomic scale particles result in poor stored energy levels likely due to the oxidation of essentially all the starting metal.

FIG. 1 is a depiction derived from a scanning electron micrograph (SEM) image of composite particle 100 according to an embodiment of the invention displaying an exemplary convoluted lamellar structure obtained by mechanical milling. The dark appearing layer 101 is one component, such as a metal oxide (e.g., CuO), while the light appearing layer 102 is the other component, a metal or metal alloy (e.g., Al). The thickness of the respective layers 101 and 102 can be seen to be on the order of about 100 nm, with significant layer thickness variation shown. Composite particle 100 evidences very little porosity. With further milling, which as described above is not generally desirable for thermites, true alloying can occur at the atomic level resulting in the formation of solid solutions, intermetallics, or even amorphous phases.

The average composite particles can be less than 10 μm in dimension, as is the exemplary particle shown in FIG. 1. The metal and metal oxide regions of the particles are generally smaller than 1 μm, and as noted above can average 100 nm or less. Such dimensions are achievable via cryomilling conditions disclosed herein where the thermal energy is sufficiently removed from the mixture such that the thermite reaction is not measurably initiated during the milling. Unlike other milling protocols, such as arrested reaction milling, not only can smaller regions of metal and/or metal oxide be achieved, but the processing window with respect to milling time can be extended such that frequent stopping for sampling and analysis is not required to determine that a desired particle size has been produced and without the danger that initiation of the thermite reaction does not result between sampling during the milling process. The cryogenic ball milling process can be developed as a continuous process.

Figure 2:
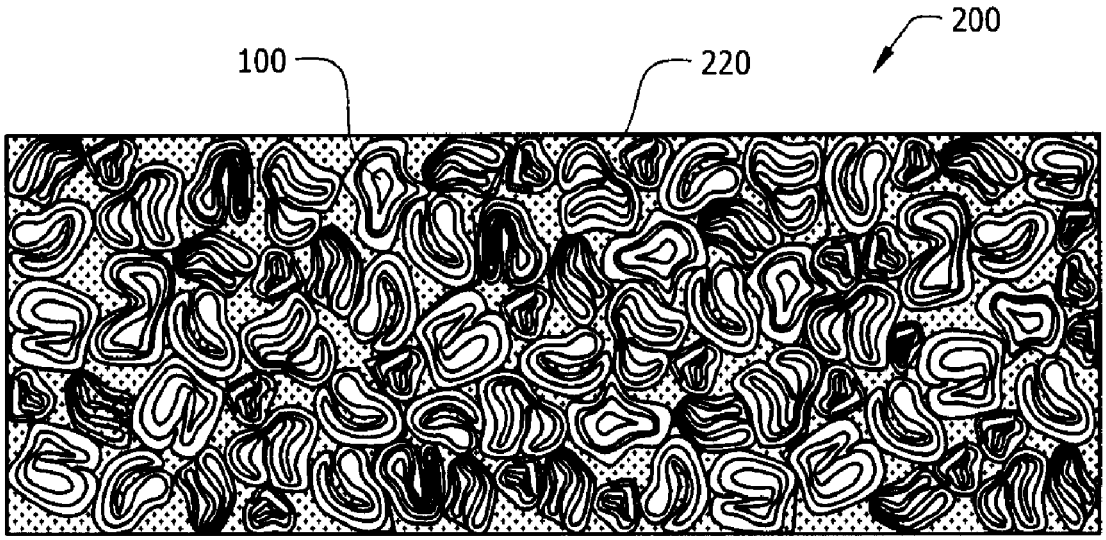
FIG. 2 is a depiction of a consolidated object comprising a plurality of pressed composite particles together with a binder, according to an embodiment of the invention.

FIG. 2 is a depiction of a consolidated object 200 comprising a plurality of pressed composite particles 100 together with a binder 220, according to an embodiment of the invention. The binder fills much of the porosity that would otherwise be present between the particles for consolidated object 200.

In one embodiment, a plurality of particles 100 are placed in a tube and a press is used to force them closer to one another. This pressing generally comprises cold pressing, such as performed at <−50° C. to prevent partial reaction. The result after pressing is generally a cold pressed compacted powder that will have significant voids where the particles were not fully squeezed together. Total densities of cold pressed powders are generally above 50%, and less than 95%, typically 70% to 90%.

The consolidated object benefits mechanically from the introduction of binder 120 as a fluid. The binder can be an organic binder. The organic binder can comprise polymer, such as a thermosetting or thermoplastic polymer. In one embodiment the binder 120 comprises an energetic material, such as the organic explosive trinitrotoluene (TNT). An explosive binder such as TNT generally increases the total stored energy, and may also increase the speed at which the energy is released from the thermite/organic composite material, due to the much higher reaction velocities in organic chemical explosives.

Disclosed embodiments may be embodied in other forms without departing from the spirit or essential attributes thereof and, accordingly, reference should be had to the following claims rather than the foregoing specification as indicating the scope of the disclosed embodiments herein.

In the preceding description, certain details are set forth in conjunction with the described embodiment of the present invention to provide a sufficient understanding of the invention. One skilled in the art will appreciate, however, that the invention may be practiced without these particular details. Furthermore, one skilled in the art will appreciate that the example embodiments described above do not limit the scope of the present invention and will also understand that various modifications, equivalents, and combinations of the disclosed embodiments and components of such embodiments are within the scope of the present invention.

Moreover, embodiments including fewer than all the components of any of the respective described embodiments may also within the scope of the present invention although not expressly described in detail. Finally, the operation of well known components and/or processes has not been shown or described in detail below to avoid unnecessarily obscuring the present invention.

One skilled in the art will understood that even though various embodiments and advantages of the present Invention have been set forth in the foregoing description, the above disclosure is illustrative only, and changes may be made in detail, and yet remain within the broad principles of the invention. For example, Alternatives for the thermite composition and other variations on the milling process will be apparent to those skilled in the art.

We claim:

1. A process for the preparation of composite thermite particles, comprising:

providing at least one metal oxide and at least one metal capable of reducing said metal oxide, and milling said metal oxide and said metal at a temperature below −50° C. to form a convoluted lamellar structure comprising alternating metal oxide layers and metal layers, wherein said metal oxide layers and said metal layers both have an average thickness between 10 nm and 1 μm.

2. The process of claim 1, wherein said temperature is a cryogenic temperature.

3. The process of claim 1, wherein said particles have a dimension between 1 μm and 100 μm.

4. The process of claim 1, wherein said metal oxide layers and said metal layers both have an average thickness of between 10 nm and 0.1 μm, and said particles have a dimension between 0.3 μm and 10 μm.

5. The process of claim 1, further comprising the step of pressing a plurality of said particles to form a consolidated object.

6. The process of claim 5, wherein said pressing is performed a temperature below −50° C.

7. The process of claim 5, further comprising adding a fluidic binder before said pressing.

8. The process of claim 7, wherein said fluidic binder comprises an organic binder.

9. The process of claim 7, wherein said fluidic binder comprises an organic explosive.

10. The process of claim 9, wherein said organic explosive comprises TNT.

11. The process of claim 1, wherein said metal oxide layer comprises at least one selected from the group consisting of CuO, $CuO_2$, $Fe_2O_3$, CoO, NiO, $MoO_3$, $Fe_3O_4$, $WO_3$, $SnO_4$, $Cr_2O_3$ and $MnO_2$.

12. The process of claim 1, wherein said metal layers comprise at least one of the group consisting of Al, Zr, Mg, Be, B and Si.

13. The process of claim 1, wherein said metal layers comprise Al and said metal oxide layers comprise CuO.

14. The process of claim 1, wherein molar proportions of said metal oxide layer and said metal layer is within 30% of being stoichiometric for a thermite reaction.

15. The process of claim 1, wherein said temperature is maintained below said −50° C. for an entire duration of said milling.

* * * * *